US009038602B2

(12) United States Patent
Agneray et al.

(10) Patent No.: US 9,038,602 B2
(45) Date of Patent: May 26, 2015

(54) MOUNTING SYSTEM FOR A RESONATING NEEDLE INJECTION DEVICE

(75) Inventors: Andre Agneray, Boulogne Billancourt (FR); Nadim Malek, Versailles (FR); Laurent Levin, Paris (FR)

(73) Assignee: RENAULT S.A.S., Boulogne Billancourt (FR)

( * ) Notice: Subject to any disclaimer, the term of this patent is extended or adjusted under 35 U.S.C. 154(b) by 680 days.

(21) Appl. No.: 13/392,140

(22) PCT Filed: Jun. 22, 2010

(86) PCT No.: PCT/FR2010/051263

§ 371 (c)(1),
(2), (4) Date: May 4, 2012

(87) PCT Pub. No.: WO2011/023867

PCT Pub. Date: Mar. 3, 2011

(65) Prior Publication Data

US 2012/0204838 A1 Aug. 16, 2012

(30) Foreign Application Priority Data

Aug. 24, 2009 (FR) ..... 09 55759

(51) Int. Cl.
*F02M 61/14* (2006.01)
*F02M 69/04* (2006.01)

(52) U.S. Cl.
CPC ..... *F02M 69/041* (2013.01); *F02M 61/14* (2013.01)

(58) Field of Classification Search
CPC . F02M 31/14; F02M 2200/856; F02M 55/04; F02M 2200/09
USPC ..... 123/470, 472, 467
See application file for complete search history.

(56) References Cited

U.S. PATENT DOCUMENTS 4,295,452 A * 10/1981 Lembke et al. ..... 123/470
6,481,421 B1 * 11/2002 Reiter ..... 123/470
6,745,956 B1 * 6/2004 Bantle et al. ..... 239/533.3
7,444,992 B2 * 11/2008 Ricci ..... 123/470

(Continued)

FOREIGN PATENT DOCUMENTS

EP 1 262 652 12/2002
EP 1 837 517 9/2007

(Continued)

OTHER PUBLICATIONS

International Search Report Issued Sep. 23, 2010 in PCT/FR10/51263 Filed Jun. 22, 2010.

*Primary Examiner* — Thomas Moulis
*Assistant Examiner* — Elizabeth Hadley
(74) *Attorney, Agent, or Firm* — Oblon, McClelland, Maier & Neustadt, L.L.P.

(57) ABSTRACT

A device for injecting fuel over a cylinder head of an engine, including a tubular body, an injection nozzle forming an extension of the tubular body, a needle extending coaxially to the nozzle in a form of a rod, an end of which includes a head forming a valve on a seat supported by the injection nozzle, and an actuator configured to cause a movement of the head so as to open the valve, the needle configured to axially resonate when the same is subjected to axial pulses at a predetermined nominal frequency by the actuator. A system for mounting the device includes a spacer for bearing on the cylinder head, as well as on a front surface of the tubular body at the connection to the nozzle.

6 Claims, 2 Drawing Sheets

(56) References Cited

U.S. PATENT DOCUMENTS

| | | | | |
|---|---|---|---|---|
| 7,784,708 | B2 * | 8/2010 | Guerbaoui et al. | 239/4 |
| 8,151,760 | B2 * | 4/2012 | Hoefner | 123/294 |
| 8,714,139 | B2 * | 5/2014 | Holt et al. | 123/470 |
| 2007/0221176 | A1 | 9/2007 | Hardy | |
| 2008/0141979 | A1 * | 6/2008 | Chang | 123/470 |
| 2010/0187329 | A1 * | 7/2010 | Agneray et al. | 239/102.2 |
| 2011/0265767 | A1 * | 11/2011 | Xu et al. | 123/470 |

FOREIGN PATENT DOCUMENTS

| | | | |
|---|---|---|---|
| FR | 2 832 189 | | 5/2003 |
| FR | 2889257 | A1 * | 2/2007 |
| FR | 2 918 123 | | 1/2009 |

* cited by examiner

MOUNTING SYSTEM FOR A RESONATING NEEDLE INJECTION DEVICE

BACKGROUND

The invention pertains to a system for installation of a resonating needle type liquid injector, intended in particular for a thermal engine.

From document FR 2 889 257 one is familiar with an injector whose opening is achieved by placing a needle in resonance. Such a device comprises a tubular body, an injector nose prolonging the tubular body. A needle is lodged in the nose, extending lengthwise in the form of a rod. One end of the needle comprises a head forming a valve on a seat carried by the nose. The device also comprises an actuator able to cause a displacement of the head to open the valve by placing the needle in axial resonance with axial impulses at a given nominal frequency. The nominal frequency is typically between 15 and 30 kHz, but it can be higher.

During the functioning of the device, the head of the needle comes to bear against the seat before moving away from it, leaving an opening for the fuel between them. The nose is thus subjected to axial impulses which also have a tendency to place it in resonance. One thus chooses preferably a nose shape with a constant cross section and a length that is close to a multiple of the half-wavelength for the nominal frequency. Thus, the resonance of the nose favors that of the needle, boosting the amplitude of the opening of the injector.

However, for classical metal materials such as steel, this condition translates into a substantial length of nose as compared to the classical thickness of a cylinder head wall. If the base of the nose, opposite the seat, serves as a support for the device against the cylinder head, the nose will project into the combustion chamber where the fuel is supposed to be injected. But this is not compatible with the space constraints in the combustion chamber or with the thermal constraints that the device can withstand.

BRIEF SUMMARY

Thus, the invention is intended to provide a system for installation of a resonating needle type device on a cylinder head that is able to enhance the effectiveness of the device.

With this purpose in mind, the object of the invention is a system for installation of a fuel injector on an engine cylinder head, the device comprising a tubular body, an injector nose prolonging the tubular body, a needle extending coaxially to the nose in the shape of a rod and whose one end has a head forming a valve on a seat carried by the injector nose, an actuator able to cause a displacement of the head to open the valve, the needle being able to enter into axial resonance when subjected by the actuator to axial impulses at a given nominal frequency, the system comprising the injector, characterized in that it comprises a brace intended to bear against one surface of the cylinder head, on the one hand, and on the other hand bearing against a front surface of the tubular body in the area of the connection to the nose.

The use of a brace makes it possible to adjust the position of the nose of the device relative to the combustion chamber while being free to choose the length of the nose regardless of the thickness of the cylinder head wall. Thus, one can obey the positional constraints of the injector while preserving optimal efficiency of the device by the choice of the length of the nose. The brace, for example, has the shape of a collar surrounding the base of the nose.

In supplemental manner, the system furthermore comprises a flange intended to be attached to the cylinder head and flattening the tubular body against the brace by bearing against a clamping shoulder. Thus, the device is held constantly in place on the brace by the flange.

According to one advantageous characteristic, the brace and the portion of the tubular body between the clamping shoulder and the front surface have such lengths that the time of propagation of a sound wave in the portion of the tubular body between the clamping shoulder and the front surface, added to the time of propagation in the brace, is a multiple of one half-period of the nominal frequency. It is found that, according to this characteristic, an oscillatory phenomenon can be established between the flange and the cylinder head, passing through the injector and the brace. This oscillatory phenomenon is excited by the vibrations coming from the nose and arriving at the front surface. Because of their mass, the flange and the cylinder head behave like displacement nodes for this oscillatory phenomenon. The brace and the portion of the tubular body between the clamping shoulder and the front surface enter into resonance and enable oscillations at the nominal frequency at the front surface, which improves the efficiency of the injector.

According to one particular design, the brace comprises at least one inner groove and at least one outer groove. It is noted that with such a brace, the time of propagation of a wave is increased by the same geometrical length as compared to a brace without groove. On the other hand, one obtains the same time of propagation with a decreased geometrical length. One can thus modify the geometrical length of the brace while preserving a given time of propagation. It is possible, for example, to determine a position of the nose in the combustion chamber while obeying the characteristics of time of propagation, and this regardless of the thickness of the cylinder head wall.

Advantageously, the grooves of the brace are distributed axially, alternating on the inside and the outside. One thus produces a kind of baffles, seen in longitudinal section of the brace. It is noted that such an arrangement makes it possible to vary quite considerably the time of propagation, for example up to twice the time of propogation, of a wave in a brace without grooves.

The nominal frequency is in a range extending from 10 to 30 kHz, for example.

BRIEF DESCRIPTION OF THE DRAWINGS

The invention will be better understood and other features and advantages will become apparent upon reading the following specification, making reference to the drawings, where.

DETAILED DESCRIPTION

Figure 1:
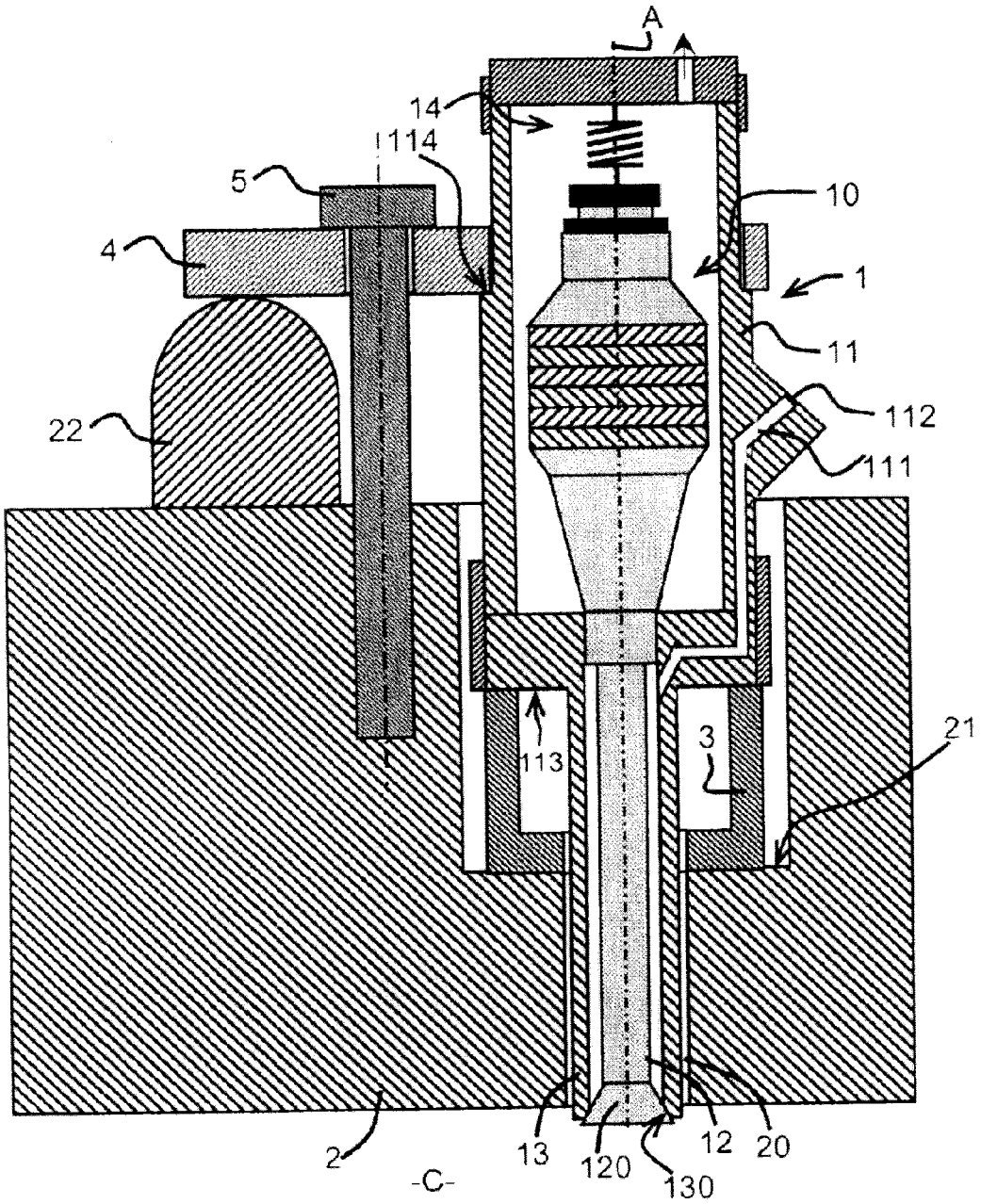
FIG. 1 is a cross section of a system of installation according to a first embodiment of the invention.

A first embodiment of the liquid injector 1 according to the invention is shown in FIG. 1. It comprises a tubular body 11 extending along a lengthwise axis A and prolonged by a nose 13. The nose 13 has a tubular shape of constant cross section and in which a needle 12 is mounted so that it can slide. The needle 12 has at one end a head 120 forming a valve on a seat 130 of the nose 13. A feed conduit 111 intended to channel a liquid such as fuel extends in the device 1 from an inlet 112 and around the needle 12 as far as the valve. The device 1 has a spring 14 that holds the head 120 of the needle 12 against the seat 130 so as to close the valve and normally prevent the liquid from escaping.

The device 1 furthermore comprises an actuator 10 of piezoelectric material, able to cause a displacement of the head 120 of the needle 12 to open the valve. The actuator 10 forms with the needle 12 a movable unit mounted so it can slide in the tubular body 11.

The device 1 is mounted on a cylinder head 2, defining a combustion chamber C. The wall of the cylinder head 2 is pierced by a through hole 20, in which the nose 13 of the device is introduced. The device is placed so that the nose 13 projects into the combustion chamber C by one or two millimeters, for example. The cylinder head 2 has a surface 21 around the outlet of the through hole 20 opposite the combustion chamber C. A brace 3 of tubular shape is placed between a front surface 113 of the tubular body 11 and the cylinder head 2 surface and bears against these two surfaces 21, 113.

The tubular body 11 comprises on its outer surface a clamping shoulder 114. A flange 4 bears on the one hand against the said clamping shoulder 114 and on a boss 22 of the cylinder head 2. A screw 5 flattens the flange 4 against these two points of support 22, 114.

When one wishes to perform a fuel injection, the fuel is pressurized, in particular, in the space between the nose 13 and the needle 12. The spring 14 maintains the head 120 bearing against the seat 130 and closes the valve. The piezoelectric actuator 10 is energized by a current at the nominal frequency, for example, 30 kHz, which causes waves of compression or relaxation to be sent in the axial direction. Thus, the needle 12 receives these impulses in the axial direction and it is placed in resonance, extending and retracting. When the needle 12 moves away, the head 120 leaves its support against the seat 130 and lets through fuel, which is thus injected into the combustion chamber C. When the needle 12 is retracted, the head 120 comes to rest against the seat 130.

The consecutive dockings of the head 120 with the seat 130 generate waves that are likewise transmitted to the nose 13 in the axial direction. As a rule, the length of the nose 13 is chosen so that the time of propagation of a sound wave in the nose is a multiple of a half-period of the nominal frequency, so that when placed in resonance, the base of the nose 13 at the front surface 113 is a node of displacement. However, oscillations can still be produced at the front surface 113. These oscillations are then transmitted in the portion of the tubular body 11 between the front surface 113 and the clamping shoulder 114, as well as in the brace 3.

Figure 2:
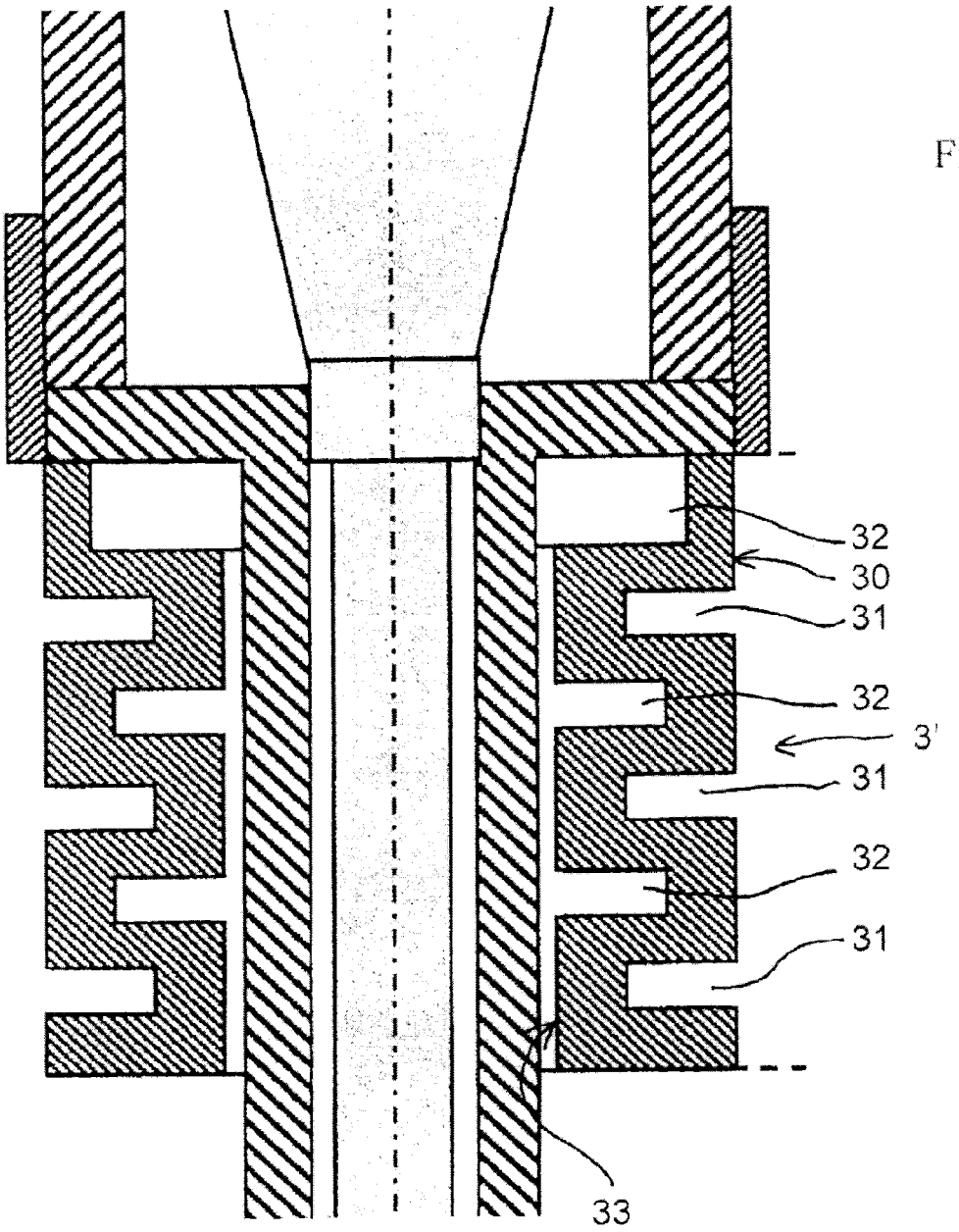
FIG. 2 is a view similar to FIG. 1 of a system of installation according to a second embodiment of the invention.

In the second embodiment, shown in FIG. 2, the brace 3' comprises three outer circular grooves 31, made on the outer cylindrical surface 30 of the brace 3'. It also comprises three inner circular grooves 32 made on the inner cylindrical surface 33. Seen in a longitudinal section of the wall of the brace 3', the outer grooves 31 and the inner grooves 32 are staggered. The depth of the grooves 31, 32 exceeds half the thickness of the wall of the brace 3'. It is noted that the time of propagation of a sound wave between the extreme surfaces of such a brace 3' is practically twice for of a similar brace of the same geometrical length, but without grooves.

The invention claimed is:

1. A system for installation of a fuel injector on an engine cylinder head, the system comprising:

the fuel injector, the fuel injector including:

a tubular body;

an injector nose prolonging the tubular body;

a needle extending coaxially to the nose in a shape of a rod and whose one end includes a head forming a valve on a seat carried by the injector nose;

an actuator configured to cause a displacement of the head to open the valve;

wherein the needle is configured to enter into axial resonance when subjected by the actuator to axial impulses at a given nominal frequency;

a brace configured to bear against one surface of the cylinder head and to bear against a front surface of the tubular body at a connection to the nose; and a flange configured to be attached to the cylinder head and flattening the tubular body against the brace by bearing against a clamping shoulder, wherein the brace and a portion of the tubular body between the clamping shoulder and the front surface have such lengths that a time of propagation of a sound wave in the portion of the tubular body between the clamping shoulder and the front surface, added to a time of propagation in the brace, is a multiple of one half-period of the nominal frequency.

2. The system according to claim 1, wherein the brace comprises at least one inner groove and at least one outer groove.

3. The system according to claim 2, wherein the grooves of the brace are distributed axially, alternating on the inside and the outside.

4. The system according to claim 1, wherein the nominal frequency is in a range extending from 10 to 30 kHz.

5. The system according to claim 1, wherein the brace surrounds a base of the nose.

6. The system according to claim 2, wherein a depth of the inner groove and a depth of the outer groove exceed half of a thickness of a wall of the brace.

* * * * *